US011932358B2

(12) United States Patent
Kim

(10) Patent No.: US 11,932,358 B2
(45) Date of Patent: Mar. 19, 2024

(54) FLOTATION SYSTEM AND SHOES THEREOF

(71) Applicant: Chung Kim, Holly Springs, NC (US)

(72) Inventor: Chung Kim, Holly Springs, NC (US)

( * ) Notice: Subject to any disclaimer, the term of this patent is extended or adjusted under 35 U.S.C. 154(b) by 104 days.

(21) Appl. No.: 17/680,874

(22) Filed: Feb. 25, 2022

(65) Prior Publication Data

US 2022/0306250 A1 Sep. 29, 2022

Related U.S. Application Data

(60) Provisional application No. 63/166,920, filed on Mar. 26, 2021.

(51) Int. Cl.
*B63B 34/56* (2020.01)

(52) U.S. Cl.
CPC ..... *B63B 34/56* (2020.02)

(58) Field of Classification Search
CPC ..... B63B 34/56; B63B 34/565
USPC ..... 441/65, 72, 76, 79
See application file for complete search history.

(56) References Cited

U.S. PATENT DOCUMENTS

| | | | | |
|---|---|---|---|---|
| 1,611,634 | A * | 12/1926 | Del Pino | B63B 34/56 440/32 |
| 4,624,646 | A * | 11/1986 | Strohmeier | B63B 32/35 441/76 |
| 5,795,204 | A * | 8/1998 | Bruner | A63B 31/11 441/64 |
| 6,729,049 | B1 * | 5/2004 | Hui | A43B 3/16 36/7.6 |
| 6,855,024 | B2 * | 2/2005 | Rothschild | B63B 34/56 441/77 |
| 8,608,524 | B2 * | 12/2013 | Jeong | B63B 34/56 441/76 |
| 8,845,372 | B2 * | 9/2014 | Farmer | B63B 34/56 440/102 |
| 11,376,472 | B2 * | 7/2022 | Emadikotak | A63B 31/14 |

* cited by examiner

*Primary Examiner* — Daniel V Venne
(74) *Attorney, Agent, or Firm* — The Iwashko Law Firm, PLLC; Lev Ivan Gabriel Iwashko

(57) ABSTRACT

A flotation system, including a plurality of flotation shoes to float on a body of water, the plurality of flotation shoes including a first shoe to receive a first foot of a user therein, a second shoe to receive a second foot of a user therein, and a plurality of connecting members removably connected to at least one of the first shoe and the second shoe to bind the first shoe to the second shoe, and a support device to facilitate at least one of walking on a ground surface and movement on the body of water.

3 Claims, 3 Drawing Sheets

FLOTATION SYSTEM AND SHOES THEREOF

CROSS-REFERENCE TO RELATED APPLICATIONS

This application claims priority under 35 USC § 120 from U.S. Provisional Application No. 63/166,920, entitled "Flotation System and Shoes Thereof," which was filed on Mar. 26, 2021, in the United States Patent and Trademark Office, the disclosure of which is incorporated herein in its entirety by reference.

BACKGROUND

1. Field

The present general inventive concept relates generally to flotation system, and particularly, to flotation shoes.

2. Description of the Related Art

Water activities are enjoyed by millions of people all around the world. Some types of water-based activities that people participate in include surfing, snorkeling, and/or sailing. Currently, people do not have the ability to walk on water. Furthermore, having the ability to walk on water could save people from drowning in sudden floods considering many uncontrollable weather situations have occurred in recent years.

Although, other types of footwear exist to traverse water, such as water skis and/or water boards. None of these types of footwear are specifically designed to be worn on the foot. Also, these other types of footwear require movement for a user to stay afloat.

Therefore, there is a need for flotation shoes that allow people to walk on water.

SUMMARY

The present general inventive concept provides a flotation system.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a flotation system, including a plurality of flotation shoes to float on a body of water, the plurality of flotation shoes including a first shoe to receive a first foot of a user therein, a second shoe to receive a second foot of a user therein, and a plurality of connecting members removably connected to at least one of the first shoe and the second shoe to bind the first shoe to the second shoe, and a support device to facilitate at least one of walking on a ground surface and movement on the body of water.

The first shoe and the second shoe may each include a foot receiving aperture to receive a foot therein, and a seat portion to receive the user thereon.

The flotation system may further include a water valve disposed within at least a portion of the foot receiving aperture and connected to the seat portion to expel air into the foot receiving aperture in response to depressing the seat portion.

The water valve may remain closed in absence of an application of force on the seat portion.

The flotation system may further include a plurality of connecting hooks disposed on at least a portion of the first shoe and the second shoe to prevent separation of the first shoe and the second shoe in response to connecting the plurality of connecting hooks to the first shoe and the second shoe.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
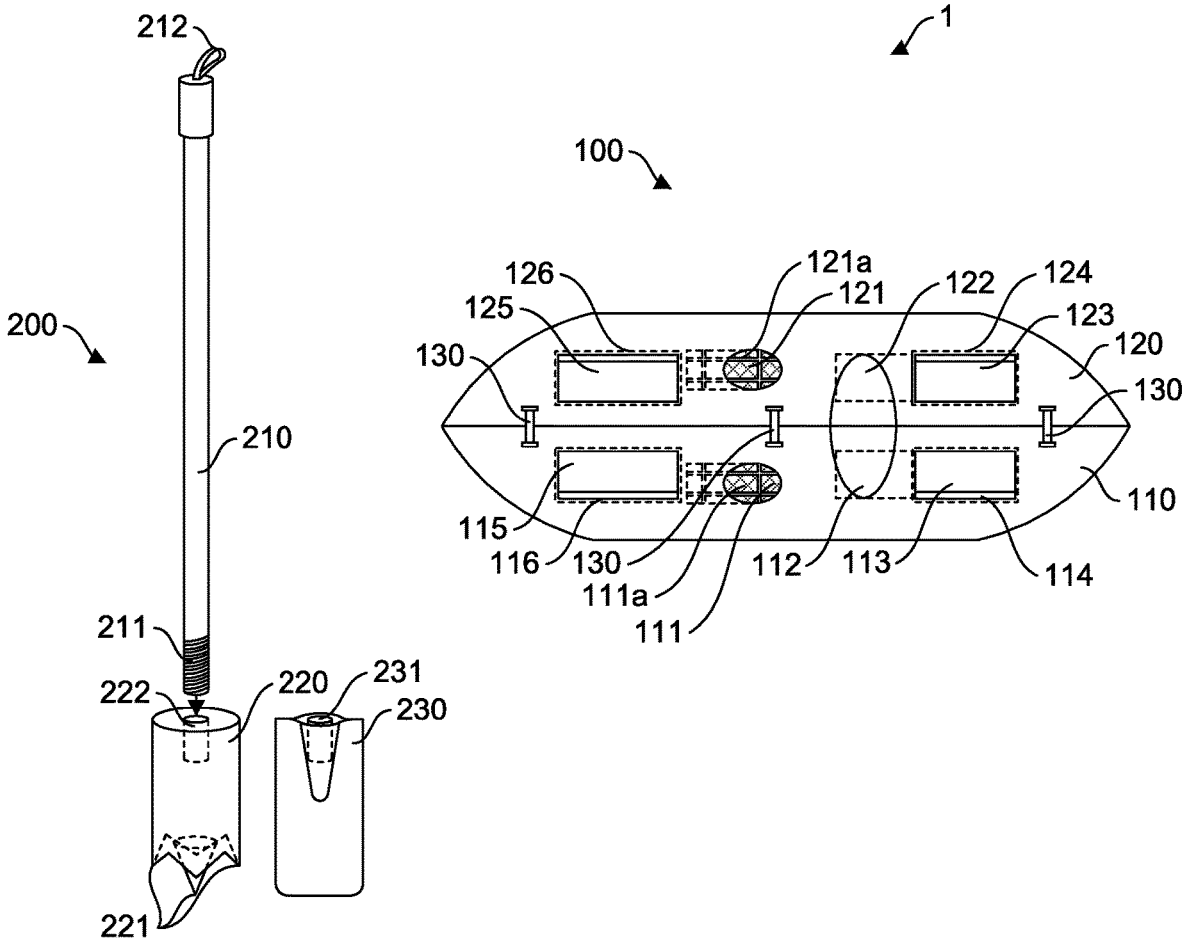
FIG. 1 illustrates a perspective view of a flotation system, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Flotation System 1
Flotation Shoes 100
First Shoe 110
First Foot Receiving Aperture 111
First Foot Fastener 111*a*
First Seat Portion 112
First Compartment 113
First Lid 114
Second Compartment 115
Second Lid 116
Second Shoe 120
Second Foot Receiving Aperture 121
Second Foot Fastener 121*a*
Second Seat Portion 122
Third Compartment 123
Third Lid 124
Fourth Compartment 125
Fourth Lid 126
Connecting Members 130
Connecting Hooks 140
Water Valve 150
Pipe 151
Support Device 200
Pole 210
Threaded End 211
Looped End 212
Walking Connector 220
Spikes 221
Pole Receiving Aperture 222
Paddle 230
Pole Receiving Aperture 231

FIG. 1 illustrates a perspective view of a flotation system 1, according to an exemplary embodiment of the present general inventive concept.

The flotation system 1 may be constructed from at least one of metal, plastic, wood, glass, and rubber, etc., but is not limited thereto. Moreover, the flotation system 1 may be highly durable and resistant to damage from weather, different climates, and/or environments.

The flotation system 1 may include flotation shoes 100 and a support device 200, but is not limited thereto.

Figure 2A:
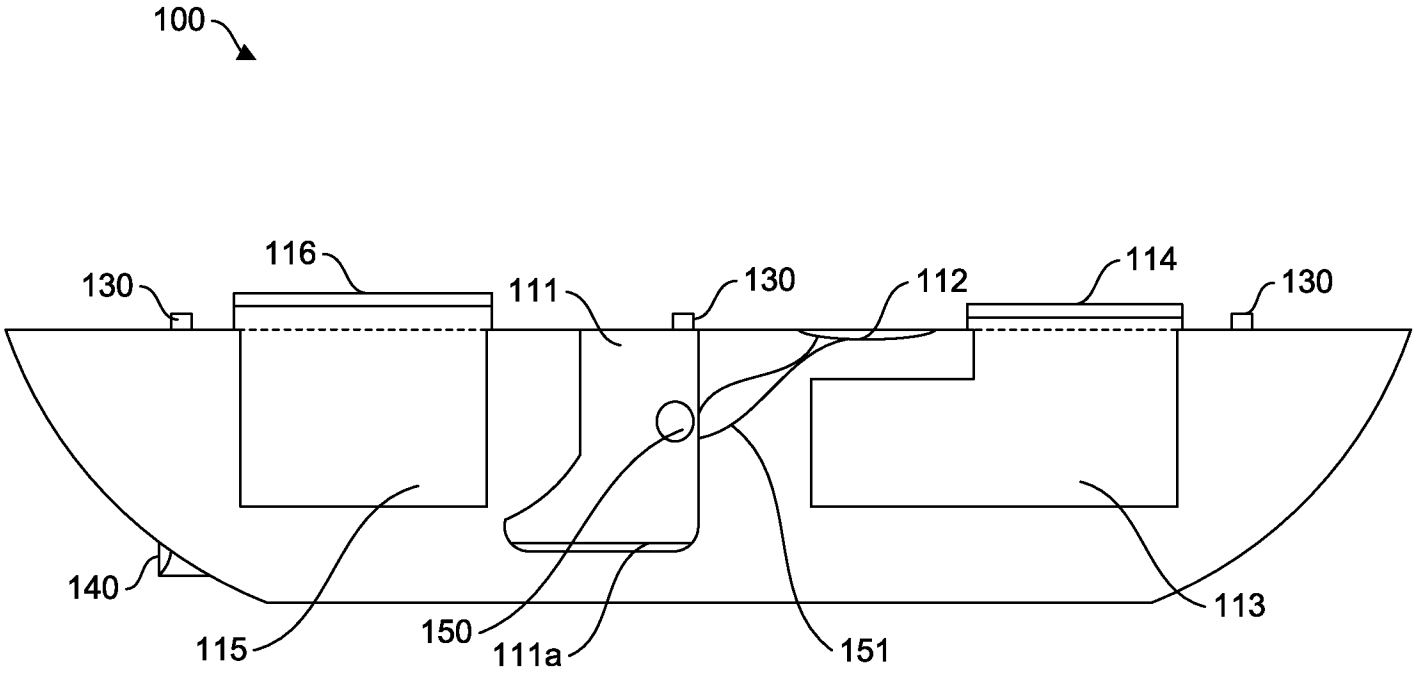
FIG. 2A illustrates a longitudinal sectional view of flotation shoes, according to an exemplary embodiment of the present general inventive concept.

FIG. 2A illustrates a longitudinal sectional view of flotation shoes 100, according to an exemplary embodiment of the present general inventive concept.

Figure 2B:
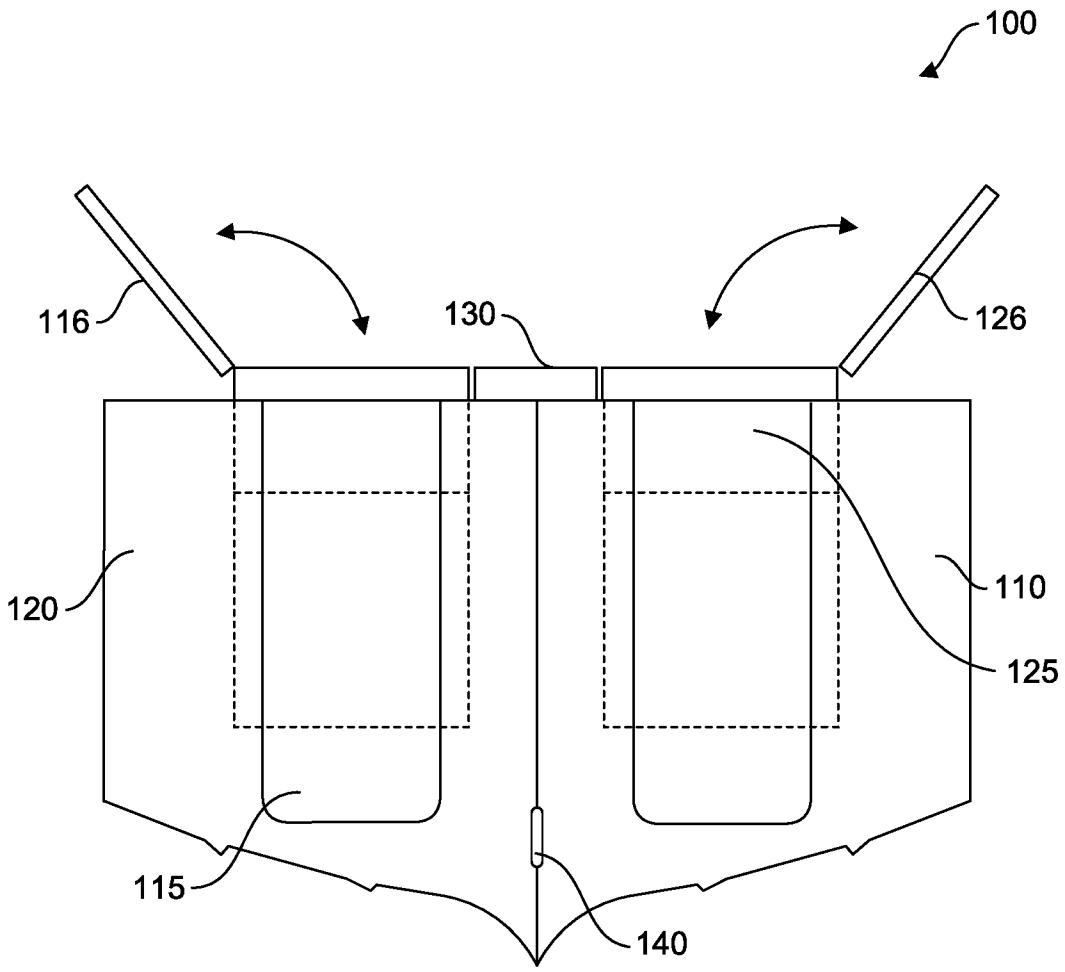
FIG. 2B illustrates a front sectional view of the flotation shoes, according to an exemplary embodiment of the present general inventive concept.

FIG. 2B illustrates a front sectional view of the flotation shoes 100, according to an exemplary embodiment of the present general inventive concept.

The flotation shoes 100 may include a first shoe 110, a second shoe 120, a plurality of connecting members 130, a plurality of connecting hooks 140, and a water valve 150, but is not limited thereto.

The first shoe 110 may include a first foot receiving aperture 111, a first seat portion 112, a first compartment 113, a first lid 114, a second compartment 115, and a second lid 116, but is not limited thereto.

The first shoe 110 may be constructed to be hollow on an interior portion thereof and weighted towards a bottom portion, such that inserting the first shoe 110 in a body of water causes displacement of the body of water equivalent to a weight of the first shoe 110. As such, the first shoe 110 may float on the body of water.

The first foot receiving aperture 111 may include a first foot fastener 111*a*, but is not limited thereto.

The first foot receiving aperture 111 may be disposed within at least a portion of the first shoe 110, and is foot shaped. The first foot receiving aperture 111 may receive a foot of a user therein.

The first foot fastener 111*a* may include hooks and loops, an adhesive (e.g., tape, glue), a strap, a string, a magnet, and/or any combination thereof, but is not limited thereto.

The first foot fastener 111*a* may connect to the foot of the user to prevent the foot from falling out of the first foot receiving aperture 111. Alternatively, the first foot fastener 111*a* may connect to another fastener on the foot (e.g., another adhesive, another hooks and loops, another magnet, etc.).

The first seat portion 112 may be disposed on at least a portion of the first shoe 110. The first seat portion 112 may be textured (e.g., a rubber surface, a ridged surface, a ribbed surface) to prevent movement (i.e. slipping) away from the first seat portion 112.

The first compartment 113 may be disposed within at least a portion of the interior portion of the first shoe 110. Moreover, the first compartment 113 may have a first portion perpendicularly disposed toward the interior portion of the first shoe 110 with respect to a first direction, and a second portion perpendicularly disposed away from the first portion with respect to a second direction. In other words, the first compartment 113 may have an "L shape. The first compartment 113 may store at least one first item (e.g., life vests, oars) therein.

The first lid 114 may be movably (i.e. pivotally and/or rotationally) disposed on at least a portion of an edge of the first compartment 113. The first lid 114 may move to cover the first compartment 113 in a first position, and move to facilitate access within the first compartment 113 in a second position. In other words, the first lid 114 may open and/or close over the first compartment 113.

The second compartment 115 may be disposed within at least a portion of the interior portion of the first shoe 110. Moreover, the second compartment 115 may store at least one second item (e.g., food) therein.

The second lid 116 may be movably (i.e. pivotally and/or rotationally) disposed on at least a portion of an edge of the second compartment 115. The second lid 116 may move to cover the second compartment 115 in a first position, and move to facilitate access within the second compartment 115 in a second position. In other words, the second lid 116 may open and/or close over the second compartment 115.

Furthermore, the first compartment 113 may have a size (i.e. length, width, volume) greater than a size of the second compartment 115.

The second shoe 120 may include a second foot receiving aperture 121, a second seat portion 122, a third compartment 123, a third lid 124, a fourth compartment 125, and a fourth lid 126, but is not limited thereto.

The second shoe 120 may be constructed to be hollow on an interior portion thereof and weighted towards a bottom portion, such that inserting the second shoe 120 in the body of water causes displacement of the body of water equivalent to a weight of the second shoe 120. As such, the second shoe 120 may float on the body of water.

The second foot receiving aperture 121 may include a second foot fastener 121*a*, but is not limited thereto.

The second foot receiving aperture 121 may be disposed within at least a portion of the second shoe 120, and is foot shaped. The second foot receiving aperture 121 may receive a foot of a user therein.

The second foot fastener 121*a* may include hooks and loops, an adhesive (e.g., tape, glue), a strap, a string, a magnet, and/or any combination thereof, but is not limited thereto.

The second foot fastener 121*a* may connect to the foot of the user to prevent the foot from falling out of the second foot receiving aperture 121. Alternatively, the second foot fastener 121*a* may connect to another fastener on the foot (e.g., another adhesive, another hooks and loops, another magnet, etc.).

The second seat portion 122 may be disposed on at least a portion of the second shoe 120. The second seat portion 122 may be textured (e.g., a rubber surface, a ridged surface, a ribbed surface) to prevent movement (i.e. slipping) away from the second seat portion 122.

The third compartment 123 may be disposed within at least a portion of the interior portion of the second shoe 120. Moreover, the third compartment 123 may have a first portion perpendicularly disposed toward the interior portion of the second shoe 120 with respect to a first direction, and a second portion perpendicularly disposed away from the first portion with respect to a second direction. In other words, the third compartment 123 may have an "L shape. The third compartment 123 may store at least one first item (e.g., life vests, oars) therein.

The third lid 124 may be movably (i.e. pivotally and/or rotationally) disposed on at least a portion of an edge of the third compartment 123. The third lid 124 may move to cover the third compartment 123 in a first position, and move to facilitate access within the third compartment 123 in a second position. In other words, the third lid 124 may open and/or close over the third compartment 123.

The fourth compartment 125 may be disposed within at least a portion of the interior portion of the second shoe 120. Moreover, the fourth compartment 125 may store at least one second item (e.g., food) therein.

The fourth lid 126 may be movably (i.e. pivotally and/or rotationally) disposed on at least a portion of an edge of the fourth compartment 125. The fourth lid 126 may move to cover the fourth compartment 125 in a first position, and move to facilitate access within the fourth compartment 125 in a second position. In other words, the fourth lid 126 may open and/or close over the fourth compartment 125.

Furthermore, the third compartment 123 may have a size (i.e. length, width, volume) greater than a size of the fourth compartment 125.

Each of the plurality of connecting members 130 may include a rope, a string, a strap, a metal bar, a magnetic bar, and/or any combination thereof, but is not limited thereto.

The plurality of connecting members 130 may be removably connected to a latch and/or a hook on the first shoe 110 and/or the second shoe 120. Moreover, the plurality of connecting members 130 may connect and/or bind the first shoe 110 to the second shoe 120, such that the first shoe 110 and/or the second shoe 120 may be considered a single flotation device. Moreover, the first seat portion 112 and/or the second seat portion 122 may receive the user thereon. For example, the first seat portion 112 and/or the second seat portion 122 may allow the user to sit thereon.

The plurality of connecting hooks 140 may be disposed on at least a portion of the first shoe 110 and/or the second shoe 120. Additionally, the plurality of connecting hooks 140 may be connected between the first shoe 110 and/or the second shoe 120 to prevent separation of the first shoe 110 and/or the second shoe 120. In other words, the plurality of connecting hooks 140 may removably connect the first shoe 110 to the second shoe 120.

The water valve 150 may include a pipe 151, but is not limited thereto.

The water valve 150 may be disposed within at least a portion of the first foot receiving aperture 111 and/or the second foot receiving aperture 121.

The pipe 151 may be connected to the water valve 150 at a first end and the first seat portion 112 and/or the second seat portion 122 at a second end. Accordingly, the water valve 150 may open to expel air into the first foot receiving aperture 111 and/or the second foot receiving aperture 121 to eject water within the first foot receiving aperture 111 and/or the second foot receiving aperture 121 in response to depressing the first seat portion 112 and/or the second seat portion 122. Conversely, the water valve 150 may remain closed until pressure is reapplied to the first seat portion 112 and/or the second seat portion 122. In other words, sitting on the first seat portion 112 and/or the second seat portion 122 may eject any water from the first foot receiving aperture 111 and/or the second foot receiving aperture 121 to keep the first foot receiving aperture 111 and/or the second foot receiving aperture 121 dry.

The support device 200 may include a pole 210, a walking connector 220, and a paddle 230, but is not limited thereto.

The pole 210 may include a threaded end 211 and a looped end 212, but is not limited thereto.

The threaded end 211 may be disposed at a first end of the pole 210. The looped end 212 may be disposed on a second end of the pole 210. The looped end 212 may facilitate gripping thereof.

The walking connector 220 may include a plurality of spikes 221 and a pole receiving aperture 222, but is not limited thereto.

The plurality of spikes 221 may be disposed at a first end of the walking connector 220. Additionally, the plurality of spikes 221 may puncture a surface, such as a ground surface in response to contacting the ground surface. Moreover, the plurality of spikes 221 may prevent movement away from the surface, such that the plurality of spikes 221 stabilize the pole 210. As such, the plurality of spikes 221 may facilitate walking by the user during use.

The pole receiving aperture 222 may receive the threaded end 211 therein. In other words, the threaded end 211 may threadably connect to the pole receiving aperture 222.

The paddle 230 may include a pole receiving aperture 231, but is not limited thereto.

The pole receiving aperture 231 may receive the threaded end 211 therein. In other words, the threaded end 211 may threadably connect to the pole receiving aperture 231.

Furthermore, the paddle 230 may be removably connected to the pole 210 to facilitate movement on the body of water while wearing the first shoe 110 and/or the second 120.

Therefore, the flotation system 1 may facilitate walking on the body of water. Moreover, the flotation shoes 100 may remain afloat without movement across the body of water.

The present general inventive concept may include a flotation system 1, including a plurality of flotation shoes

100 to float on a body of water, the plurality of flotation shoes 100 including a first shoe 110 to receive a first foot of a user therein, a second shoe 120 to receive a second foot of a user therein, and a plurality of connecting members 130 removably connected to at least one of the first shoe 110 and the second shoe 120 to bind the first shoe 110 to the second shoe 120, and a support device 200 to facilitate at least one of walking on a ground surface and movement on the body of water.

The first shoe 110 and the second shoe 120 may each include a foot receiving aperture 111/121 to receive a foot therein, and a seat portion 112/122 to receive the user thereon.

The flotation system 1 may further include a water valve 150 disposed within at least a portion of the foot receiving aperture 111/121 and connected to the seat portion 112/122 to expel air into the foot receiving aperture 111/121 in response to depressing the seat portion 112/122.

The water valve 150 may remain closed in absence of an application of force on the seat portion 112/122.

The flotation system 1 may further include a plurality of connecting hooks 140 disposed on at least a portion of the first shoe 110 and the second shoe 120 to prevent separation of the first shoe 110 and the second shoe 120 in response to connecting the plurality of connecting hooks 140 to the first shoe 110 and the second shoe 120.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A flotation system, comprising:

a plurality of flotation shoes to float on a body of water, the plurality of flotation shoes comprising:

a first shoe to receive a first foot of a user therein, the first shoe comprising:

a foot receiving aperture to receive the first foot therein, and a seat portion to receive the user thereon, a second shoe to receive a second foot of a user therein, the second shoe comprising:

another foot receiving aperture to receive the second foot therein, and another seat portion to receive the user thereon, and a plurality of connecting members removably connected to at least one of the first shoe and the second shoe to bind the first shoe to the second shoe;

a support device to facilitate at least one of walking on a ground surface and movement on the body of water; and a water valve disposed within at least a portion of the foot receiving aperture and connected to the seat portion to expel air into the foot receiving aperture in response to depressing the seat portion.

2. The flotation system of claim 1, wherein the water valve remains closed in absence of an application of force on the seat portion.

3. The flotation system of claim 1, further comprising:

a plurality of connecting hooks disposed on at least a portion of the first shoe and the second shoe to prevent separation of the first shoe and the second shoe in response to connecting the plurality of connecting hooks to the first shoe and the second shoe.

* * * * *